US008001802B2

(12) United States Patent
Choi et al.

(10) Patent No.: US 8,001,802 B2
(45) Date of Patent: Aug. 23, 2011

(54) AIR CONDITIONER

(75) Inventors: Chang Min Choi, Seoul (KR); Sai Kee Oh, Seoul (KR); Baik Young Chung, Seoul (KR)

(73) Assignee: LG Electronics Inc., Seoul (KR)

( * ) Notice: Subject to any disclaimer, the term of this patent is extended or adjusted under 35 U.S.C. 154(b) by 433 days.

(21) Appl. No.: 12/042,993

(22) Filed: Mar. 5, 2008

(65) Prior Publication Data

US 2008/0236185 A1 Oct. 2, 2008

(30) Foreign Application Priority Data

Mar. 28, 2007 (KR) ..... 10-2007-0030211

(51) Int. Cl.
*F25B 25/00* (2006.01)

(52) U.S. Cl. ..... 62/332

(58) Field of Classification Search ..... 62/324.1, 62/324.6, 335, 434, 476, 482, 325, 238.7, 62/160

See application file for complete search history.

(56) References Cited

U.S. PATENT DOCUMENTS

| | | | | |
|---|---|---|---|---|
| 4,104,890 | A * | 8/1978 | Iwasaki | 62/324.1 |
| 4,149,389 | A * | 4/1979 | Hayes et al. | 62/79 |
| 4,194,368 | A * | 3/1980 | Bahel et al. | 62/238.6 |
| 4,949,547 | A * | 8/1990 | Shimizu | 62/79 |
| 7,464,563 | B2 * | 12/2008 | Park et al. | 62/324.6 |
| 7,493,775 | B2 * | 2/2009 | Shimamoto et al. | 62/199 |
| 2004/0237578 | A1 * | 12/2004 | Takegami et al. | 62/510 |
| 2006/0179868 | A1 * | 8/2006 | Yoon et al. | 62/324.6 |

FOREIGN PATENT DOCUMENTS

| | | | |
|---|---|---|---|
| JP | 2004-100990 | A | 4/2004 |
| JP | 2004-177067 | A | 6/2004 |
| KR | 2001-0090934 | A | 10/2001 |
| KR | 20-0300302 | Y1 | 12/2002 |
| KR | 10-0539595 | B1 | 12/2005 |
| KR | 20-0419304 | Y1 | 6/2006 |
| KR | 10-2007-0020415 | A | 2/2007 |
| KR | 10-2007-0028605 | A | 3/2007 |

* cited by examiner

*Primary Examiner* — Mohammad Ali

(74) *Attorney, Agent, or Firm* — Birch, Stewart, Kolasch & Birch, LLP

(57) ABSTRACT

An air conditioner including an indoor heat exchange unit to perform a heat exchange process by the supply and absorption of heat through the circulation of a first refrigerant, at least one outdoor heat exchange unit to perform a heat exchange process by the absorption and supply of heat through the circulation of a second refrigerant, and an intermediate connection unit to perform a heat exchange between the first refrigerant and the second refrigerant.

7 Claims, 3 Drawing Sheets

AIR CONDITIONER

CROSS-REFERENCE TO RELATED APPLICATIONS

This application claims the benefit of Korean Patent Application No. 10-2007-0030211, filed on Mar. 28, 2007, which is hereby incorporated by reference in its entirety.

BACKGROUND OF THE INVENTION

1. Field of the Invention

The present invention relates generally to an air conditioner, and more particularly, to an air conditioner that utilizes two refrigerants and an intermediate unit to provide heat exchange between the two refrigerants.

2. Description of Related Art

Generally, an air conditioner is an apparatus for heating and cooling an indoor space using a refrigerating cycle. The air conditioner generally includes components for performing a refrigerating cycle, such as an indoor heat exchanger mounted indoors for performing heat exchange with indoor air, a compressor for compressing a refrigerant, an outdoor heat exchanger mounted outdoors for performing heat exchange with outdoor air, and an expansion valve for reducing the pressure of the refrigerant to expand the refrigerant.

Recently, a heat-pump type air conditioner has been developed that is capable of performing both heating and cooling operations. The heat-pump type air conditioner includes a compressor for compressing a gaseous, low-temperature, low-pressure refrigerant into a high-temperature, high-pressure refrigerant, a condenser (an outdoor heat exchanger for the cooling operation; an indoor heat exchanger for the heating operation) for condensing the refrigerant discharged from the compressor, an expansion valve for expanding the refrigerant condensed by the condenser, i.e., the liquid refrigerant, an evaporator (an indoor heat exchanger for the cooling operation; an outdoor heat exchanger for the heating operation) for evaporating the refrigerant introduced from the expansion valve, and a four-way valve for changing the flow direction of the refrigerant according to the cooling or heating operation. The compressor, the outdoor heat exchanger, and the four-way valve are mounted in an outdoor unit, whereas the indoor heat exchanger is mounted in an indoor unit. The indoor unit and the outdoor unit are connected with each other via a refrigerant pipe.

Another conventional air conditioners is a multi-type air conditioner constructed in a structure in which a refrigerant is supplied, using a plurality of indoor units and an outdoor unit, to individually heat and cool indoor spaces where the indoor units are installed.

In the conventional multi-type air conditioner, however, the outdoor unit has only a single heat exchange mode of the refrigerant. As a result, it is not possible to use various heat exchange modes. Also, the outdoor unit of the conventional air conditioner is constructed in a structure in which the compressor is mounted in the outdoor unit. In other words, the compressor is not separated from the outdoor unit. As a result, there is a strong possibility of the outdoor unit falling due to its own weight when the outdoor unit is installed in a multi-storied building. In addition, it is difficult to repair or replace the outdoor unit or the compressor with a new one. Furthermore, the installation of the outdoor unit is restricted.

BRIEF SUMMARY OF THE INVENTION

Accordingly, the present invention is directed to an air conditioner that substantially obviates one or more problems due to limitations and disadvantages of the related art.

An object of the present invention is to provide an air conditioner that is capable of using an outdoor heat exchange unit having various heat exchange modes.

Another object of the present invention is to provide an air conditioner that is capable of minimizing system load.

To achieve these objects and other advantages and in accordance with the purpose of the invention, as embodied and broadly described herein, an air conditioner is provided. The air conditioner includes an indoor heat exchange unit to perform a heat exchange process by the supply and absorption of heat through the circulation of a first refrigerant, at least one outdoor heat exchange unit to perform a heat exchange process by the absorption and supply of heat through the circulation of a second refrigerant, and an intermediate connection unit to perform a heat exchange between the first refrigerant and the second refrigerant.

In another aspect, the intermediate connection unit may include a first compressor to compress the first refrigerant, a second compressor to compress the second refrigerant, and a hybrid device to perform heat exchange between the first refrigerant and the second refrigerant.

In a further aspect, the intermediate connection unit may include a first flow passage controller to control the flow of the first refrigerant between the intermediate connection unit and the indoor heat exchange unit, and a second flow passage controller to control the flow of the second refrigerant between the intermediate connection unit and the at least one outdoor heat exchange unit.

In a different aspect, the hybrid device may include a case that defines the external appearance of the hybrid device, and a thermal conductive fluid contained in the case such that the first refrigerant and the second refrigerant are heat-exchanged with each other via the thermal conductive fluid.

In yet another aspect, the air conditioner may include a first refrigerant pipe connected between the intermediate connection unit and the indoor heat exchange unit, and a second refrigerant pipe connected between the intermediate connection unit and the at least one outdoor heat exchange unit.

In a further aspect, the air conditioner may include a first valve system located in the first refrigerant pipe to control the flow of the refrigerant flowing through the first refrigerant pipe, and a second valve system located in the second refrigerant pipe to control the flow of the refrigerant flowing through the second refrigerant pipe. A valve controller for controlling the opening and closing of the first valve system and the second valve system may be provided.

In still a further aspect, the indoor heat exchange unit may include a plurality of sub-indoor units, the first valve system may include a plurality of first valves, each of the plurality of first valves being associated with a corresponding sub-indoor unit and the valve controller may control the plurality of first valves so as to simultaneously or selectively connect the intermediate connection unit and the sub-indoor units.

In a different aspect the at least one outdoor heat exchange unit may include a plurality of outdoor heat exchange units, the second valve system may include a plurality of second valves, each of the plurality of second valves is associated with a corresponding one of the plurality of outdoor heat exchange units, and the valve controller may control the plurality of second valves so as to simultaneously or selectively connect the intermediate connection unit and the outdoor heat exchange units.

In another aspect, the at least one outdoor heat exchange unit may be installed separately from the intermediate connection unit. The at least one outdoor heat exchange unit may be selectively connected to the intermediate connection unit.

In another aspect, the at least one outdoor heat exchange unit may include at least one of an air-cooled heat exchanger, an engine exhaust heat exchanger, a water-cooled heat exchanger, a ground source heat exchanger, and an electric heat exchanger.

In yet another aspect, the hybrid device may include a case defining the external appearance of the hybrid device, and a plurality of thermal conduction fins mounted in the case such that the first refrigerant and the second refrigerant are heat-exchanged with each other via the thermal conduction fins.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings. However, it should be understood that the detailed description and specific examples, while indicating exemplary embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE INVENTION

Reference will now be made in detail to the exemplary embodiments of the present invention, examples of which are illustrated in the accompanying drawings. Wherever possible, the same reference numbers will be used throughout the drawings to refer to the same or like parts.

Figure 1A:
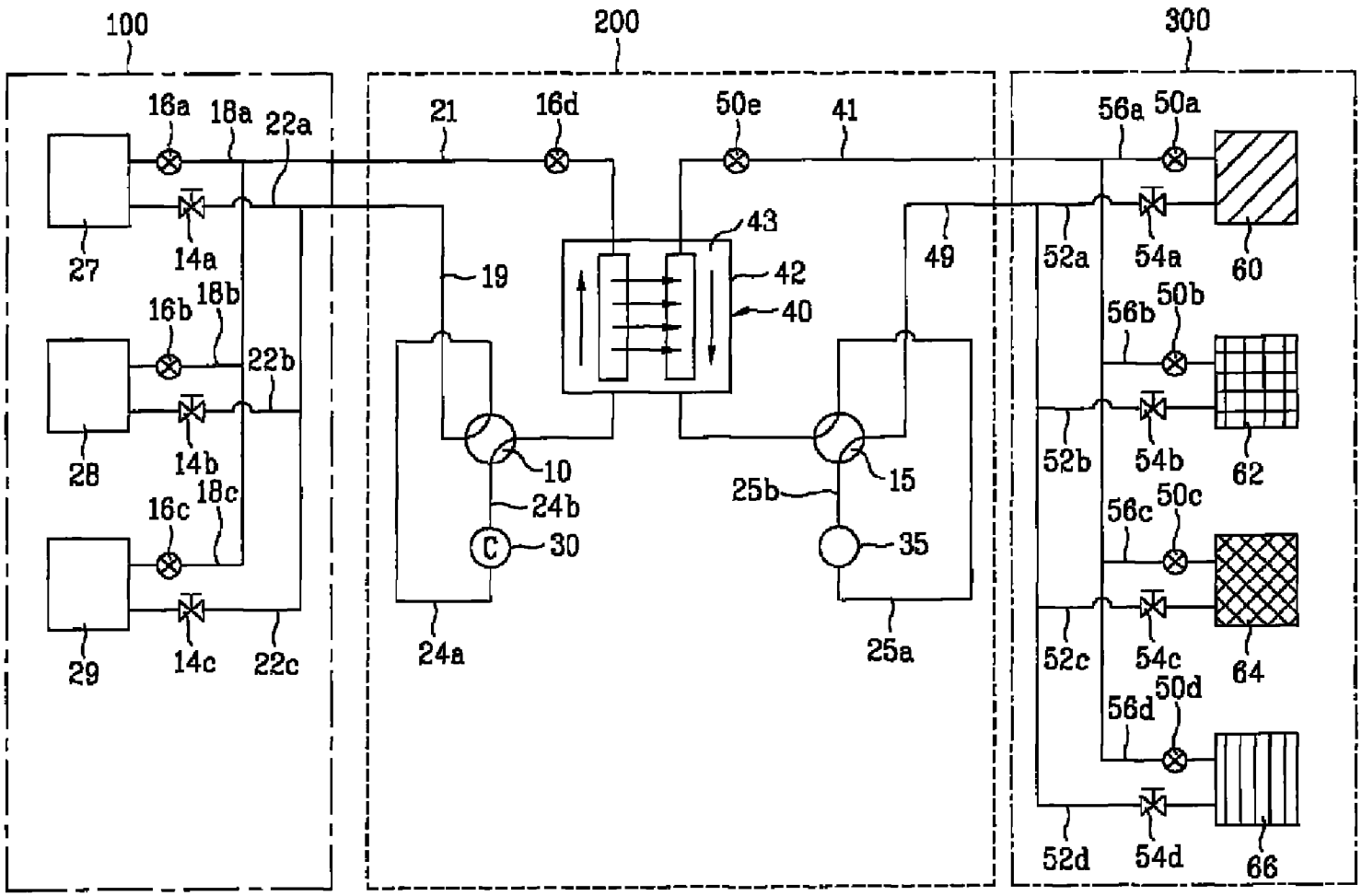
FIG. 1A is a view illustrating an exemplary embodiment of an air conditioner according to the present invention, the air conditioner operating in a cooling arrangement.
Figure 1B:
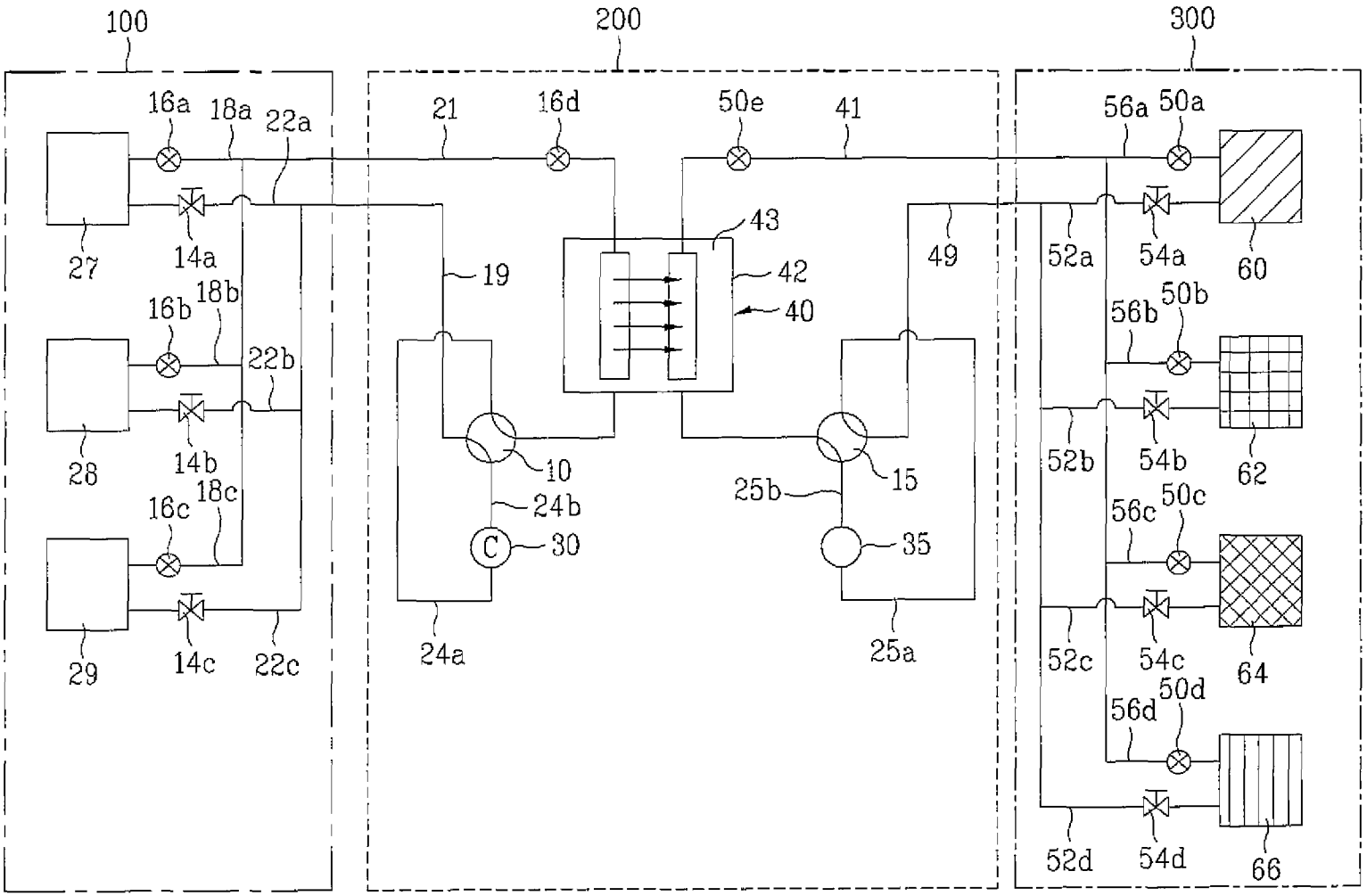
FIG. 1B is a view illustrating the air conditioner of FIG. 1A operating in a heating arrangement.

An air conditioner according to a first exemplary embodiment, as shown in FIGS. 1A and 1B, includes an indoor heat exchange unit 100 for performing a heat exchange process through the circulation of a first refrigerant, an outdoor heat exchange unit 300 for performing a heat exchange process through the circulation of a second refrigerant, and an intermediate connection unit 200 performing heat exchange between the first refrigerant and the second refrigerant. The intermediate connection unit 200 may also compress the first and second refrigerants, which may be any suitable refrigerants. Depending on the direction of refrigerant flow between the indoor heat exchange unit 100 and the intermediate connection unit 200 and the direction of refrigerant flow between the intermediate connection unit 200 and the outdoor heat exchange unit 300, the air condition either cools or heats the space where the indoor heat exchange unit is located.

The outdoor heat exchange unit 300 includes at least one outdoor heat exchanger 68 in which the heat exchange mode of the second refrigerant can be selectively used. The outdoor heat exchanger 68 may include all types of heat exchange devices, such as, for example, an air-cooled heat exchanger 60, an engine exhaust heat exchanger 62, a water-cooled heat exchanger 64, a ground source heat exchanger 66, and an electric heat exchanger (not shown).

The indoor heat exchange unit 100 includes a plurality of sub-indoor units 27, 28, and 29 for performing heat exchange between the first refrigerant and indoor air. Indoor heat exchangers (not shown) are located in the respective sub-indoor units 27, 28, and 29 for performing heat exchange between the indoor air and the first refrigerant. The sub-indoor units 27, 28, and 29 may also include indoor fans (not shown) for blowing the indoor air. While FIGS. 1A and 1B illustrate an exemplary air conditioner including the first sub-indoor unit 27, the second sub-indoor unit 28, and the third sub-indoor unit 29, the present invention is not so limited to this number of sub-indoor units.

The intermediate connection unit 200 includes a hybrid device 40, which may be in the form of a heat exchange unit, for performing heat exchange between the first refrigerant and the second refrigerant, at least one first compressor 30 for compressing the first refrigerant, and at least one second compressor 35 for compressing the second refrigerant. The intermediate connection unit 200 may further include a first flow passage controller 10 for controlling the flow direction of the first refrigerant between the intermediate connection unit 200 and the indoor heat exchange unit 100, and a second flow passage controller 15 for controlling the direction of flow of the second refrigerant between the intermediate connection unit 200 and the outdoor heat exchange unit 300. Particularly, the first and second flow passage controllers 10 and 15 may reverse the flow between the indoor heat exchange unit 100 and the intermediate connection unit 200 and the flow between the outdoor heat exchange unit 300 and the intermediate connection unit 200.

As shown in FIGS. 1A and 1B, the air conditioner according to the present invention may further include a first refrigerant pipe connected between the intermediate connection unit 200 and the indoor heat exchange unit 100 and a second refrigerant pipe connected between the intermediate connection unit 200 and the outdoor heat exchange unit 300. A first valve system may be located in the first refrigerant pipe for controlling the flow of the refrigerant flowing through the first refrigerant pipe and a second valve system is located in the second refrigerant pipe for controlling the flow of the refrigerant flowing through the second refrigerant pipe.

The structure of the first refrigerant pipe, for guiding the flow of the first refrigerant between the indoor heat exchange unit 100 and the intermediate connection unit 200, and the structure of the first valve system, located in the first refrigerant pipe, will be described in detail below.

The first refrigerant pipe includes a first circulation refrigerant pipe 21 for guiding the first refrigerant from the indoor heat exchange unit 100 to the hybrid device 40 and a second circulation refrigerant pipe 19 for guiding the first refrigerant, having passed through the hybrid device 40, to the indoor heat exchange unit 100. Specifically, one end of the first circulation refrigerant pipe 21 is connected to the hybrid device 40, and the other end of the first circulation refrigerant pipe 21 is divided into a first refrigerant branch pipe 18*a*, a second refrigerant branch pipe 18*b*, and a third refrigerant branch pipe 18*c*. The first refrigerant branch pipe 18*a* is connected to the first sub-indoor unit 27, the second refrigerant branch pipe 18*b* is connected to the second sub-indoor unit 28, and the third refrigerant branch pipe 18*c* is connected to the third sub-indoor unit 29. Also, one end of the second circulation refrigerant pipe 19 is connected to the first flow passage controller 10, and the other end of the second circulation refrigerant pipe 19 is divided into a first connection branch pipe 22*a*, a second connection branch pipe 22*b*, and a third connection branch pipe 22*c*. The first connection branch pipe 22*a* is connected to the first sub-indoor unit 27, the second connection branch pipe 22*b* is connected to the second sub-indoor unit 28, and the third connection branch pipe 22*c* is connected to the third sub-indoor unit 29.

The first valve system includes a first expansion valve 16*a* located in the first refrigerant branch pipe 18*a*, a second expansion valve 16*b* located in the second refrigerant branch pipe 18*b*, and a third expansion valve 16*c* located in the third refrigerant branch pipe 18*c*. The first expansion valve 16*a*, the second expansion valve 16*b*, and the third expansion valve 16*c* control the flow of the first refrigerant flowing through the first refrigerant branch pipe 18*a*, the second refrigerant branch pipe 18*b*, and the third refrigerant branch pipe 18*c*, respectively. In addition, the first valve system further includes a first control valve 14*a* located in the first connection branch pipe 22*a*, a second control valve 14*b* located in the second connection branch pipe 22*b*, and a third control valve 14*c* located in the third connection branch pipe 22*c*. The first control valve 14*a*, the second control valve 14*b*, and the third control valve 14*c* control the flow of the first refrigerant flowing through the first connection branch pipe 22*a*, the second connection branch pipe 22*b*, and the third connection branch pipe 22*c*, respectively. The first valve system may also include a circulation expansion valve 16*d* located in the first circulation refrigerant pipe 21 for controlling the flow of the first refrigerant flowing through the first circulation refrigerant pipe 21 independent of or in conjunction with the remaining valves of the first valve system.

A first return pipe 24*a*, into which the first refrigerant is introduced, is connected to one side of the first compressor 30 of the intermediate connection unit 200, and a first discharge pipe 24*b*, from which the first refrigerant is discharged, is connected to the other side of the first compressor 30. The first discharge pipe 24*b* is connected to the first flow passage controller 10, which controls the flow of the first refrigerant. As a result, the first circulation refrigerant pipe 21, the second circulation refrigerant pipe 19, and the first return pipe 24*a* are connected to the first flow passage controller 10.

The structure of the second refrigerant pipe, for guiding the flow of the second refrigerant between the outdoor heat exchange unit 300 and the intermediate connection unit 200, and the structure of the second valve system, located in the second refrigerant pipe, will be described in detail below.

The second refrigerant pipe includes a first connection refrigerant pipe 41 for guiding the second refrigerant from the outdoor heat exchange unit 300 to the hybrid device 40 and a second connection refrigerant pipe 49 for guiding the second refrigerant, having passed through the hybrid device 40, to the outdoor heat exchange unit 300. Specifically one end of the first connection refrigerant pipe 41 is connected to the hybrid device 40, and the other end of the first connection refrigerant pipe 41 is divided into a first refrigerant branch pipe 56a, a second refrigerant branch pipe 56*b*, a third refrigerant branch pipe 56*c*, and a fourth refrigerant branch pipe 56*d*. The first refrigerant branch pipe 56*a* is connected to the air-cooled heat exchanger 60, the second refrigerant branch pipe 56*b* is connected to the engine exhaust heat exchanger 62, the third refrigerant branch pipe 56*c* is connected to the water-cooled heat exchanger 64, and the fourth refrigerant branch pipe 56*d* is connected to the ground source heat exchanger 66. Also, one end of the second connection refrigerant pipe 49 is connected to the second flow passage controller 15, and the other end of the second connection refrigerant pipe 49 is divided into a first connection branch pipe 52*a*, a second connection branch pipe 52*b*, a third connection branch pipe 52*c*, and a fourth connection branch pipe 52*d*. The first connection branch pipe 52*a* is connected to the air cooled heat exchanger 60 the second connection branch pipe 52*b* is connected to the engine exhaust heat exchanger 62, the third connection branch pipe 52*c* is connected to the water-cooled heat exchanger 64, and the fourth connection branch pipe 52*d* is connected to the ground source heat exchanger 66.

The second valve system includes a first expansion valve 50*a* located in the first refrigerant branch pipe 56*a*, a second expansion valve 50*b* located in the second refrigerant branch pipe 56*b*, a third expansion valve 50*c* located in the third refrigerant branch pipe 56*c*, and a fourth expansion valve 50*d* located in the third refrigerant branch pipe 56*d*. The second valve system may include a first opening and closing valve 54*a* located in the first connection branch pipe 52*a*, a second opening and closing valve 54*b* located in the second connection branch pipe 52*b*, a third opening and closing valve 54*c* located in the third connection branch pipe 52*c*, and a fourth opening and closing valve 54*d* located in the fourth connection branch pipe 52*d*. The second valve system may also include a connection expansion valve 50*c* located in the first connection refrigerant pipe 41 for controlling the flow of the second refrigerant through the first connection refrigerant piper 41 independent of or in conjunction with the remaining valves of the second valve system.

A second return pipe 25*a*, into which the second refrigerant is introduced, is connected to one side of the second compressor 35 of the intermediate connection unit 200, and a second discharge pipe 25*b*, from which the second refrigerant is discharged, is connected to the other side of the second compressor 35. The second discharge pipe 25*b* is connected to the second flow passage controller 15, which controls the flow of the second refrigerant. As a result, the first connection refrigerant pipe 41, the second connection refrigerant pipe 49, and the second return pipe 25*a* are connected to the second flow passage controller 15.

As a result of this configuration, the first and second refrigerants, flowing through the first circulation refrigerant pipe 21 and the first connection refrigerant pipe 41, respectively, are heat-exchanged with each other while passing through the hybrid device 40.

The hybrid device 40 includes a case 42 defining the external appearance of the hybrid device 40 and a thermal conductive fluid 43 contained in the case 42 such that the first refrigerant and the second refrigerant are heat-exchanged with each other via the thermal conductive fluid 43. The thermal conductive fluid 43 may include water, air, and other heat-transfer media. It is understood that the hybrid device 40 is not limited to the above-described example.

For example, the hybrid device 40 may be constructed in a structure in which the first circulation refrigerant pipe 21 and the first connection refrigerant pipe 41 are fitted between a plurality of plate-shaped thermal conduction fins stacked in a configuration such that the first circulation refrigerant pipe 21 and the first connection refrigerant pipe 41 are in thermal contact with the plate-shaped thermal conduction fins. As an alternative, the first circulation refrigerant pipe 21 and the first connection refrigerant pipe 41 may be in direct contact with each other such that first refrigerant and the second refrigerant are heat-exchanged with each other. In addition, the hybrid device 40 may be constructed in a structure in which the diameter of the first circulation refrigerant pipe 21 is greater than the diameter of the first connection refrigerant pipe 41, and therefore, the first connection refrigerant pipe 41 is fitted in the first circulation refrigerant pipe 21. In other words, the hybrid device 40 may be constructed in a dual pipe structure.

The air conditioner according to this exemplary embodiment may also include a valve controller for controlling the first valve system and the second valve system. In order to simultaneously or selectively connect the intermediate connection unit and a plurality of sub-indoor units, the valve controller may control one or more valves of the first valve system corresponding to the sub-indoor units. Also, in order to simultaneously or selectively connect the intermediate connection unit and a plurality of outdoor heat exchange units, the valve controller may control one or more of the second valve system corresponding to the outdoor heat exchange units.

The operation of the air conditioner according to the present invention will be described with reference to FIGS. 1A and 1B. Various heat exchange modes may be selectively used according to the external environment as long as the outdoor heat exchange unit 300 provides a heat exchange process to the first refrigerant of the indoor heat exchange unit 100, examples of which will be described below. For example, at least one of the air-cooled heat exchanger 60, the engine exhaust heat exchanger 62, the water-cooled heat exchanger 64, the ground source heat exchanger 66, and the electric heat exchanger may be included such that the heat exchangers can be selectively used according to the heat exchange mode. Each of the outdoor heat exchangers may be selected based on the desired operation.

For example, the air-cooled heat exchanger 60 is a heat exchanger that performs heat exchange between outdoor air and a refrigerant. This may be the most commonly used heat exchanger, but many other heat exchangers are feasible.

The engine exhaust heat exchanger 62 is a heat exchanger that collects exhaust heat generated from a gas engine and heat of an engine coolant to perform a heat exchange process. The gaseous refrigerant, having high temperature and high pressure by the compressor driven by the gas engine, is condensed by the outdoor heat exchanger, whereby heat is dissipated from the refrigerant. The pressure and temperature of the refrigerant are lowered, while the refrigerant passes through the expansion valve. The refrigerant, having low pressure and low temperature, is evaporated in the indoor heat exchanger. As a result, the refrigerant takes heat from air, and therefore, air conditioning is accomplished.

The water-cooled heat exchanger 64 is a heat exchanger constructed in a structure in which a refrigerant pipe, through which a high-temperature, high-pressure refrigerant flows, is soaked in water having a high heat transfer effect. The water may be sprayed on the refrigerant pipe, or a cooling water pipe may be located around the refrigerant pipe, through which the refrigerant flows, to perform heat exchange between the refrigerant and the cooling water.

The ground source heat exchanger 66 is a heat exchanger that uses latent ground source heat located below the surface of the earth as a heat source to perform heat exchange between the refrigerant and the ground source heat. This type of heat source tends to provide a stable heat source.

The electric heat exchanger is a heat exchanger that uses an electric heater to perform heat exchange between the refrigerant and the heat generated by the electric heater.

During the cooling operation of the outdoor heat exchange unit according to the present invention, the second refrigerant of the outdoor heat exchanger 68 emits heat. Consequently, it is possible to increase the heat exchange efficiency through the use of the heat exchange mode including the air-cooled heat exchanger 60 and the water-cooled heat exchanger 64. During the heating operation of the outdoor heat exchange unit according to the present invention, the second refrigerant of the outdoor heat exchanger 68 absorbs heat. Consequently, it is possible to increase the heat exchange efficiency through the use of the heat exchange mode including the engine exhaust heat exchanger 62 and the ground source heat exchanger 66.

The cooling operation performed by the air-cooled heat exchanger 60 and the water-cooled heat exchanger 64 in the outdoor heat exchange unit will be described with reference to FIG. 1A. First, the second refrigerant is compressed by the second compressor 35, and is then discharged from the second compressor 35. Subsequently, the discharged second refrigerant is introduced into the second flow passage controller 15 through the second discharge pipe 25*b*. The second flow passage controller 15 is switched to a first mode, and therefore, the second refrigerant flows along the second connection refrigerant pipe 49. As shown in FIG. 1A, the first mode is a mode in which the second flow passage controller 15 is switched such that the second discharge pipe 25*b* is connected with the second connection refrigerant pipe 49, and the second return pipe 25*a* is connected with the first connection refrigerant pipe 41.

The second refrigerant, flowing along the second connection refrigerant pipe 49, is introduced into the outdoor heat exchanger 68, through the first connection branch pipe 52*a*, the second connection branch pipe 52*b*, the third connection branch pipe 52*c*, and the fourth connection branch pipe 52*d*, and the second refrigerant is condensed in the outdoor heat exchanger 68.

The second refrigerant, distributed through the first connection branch pipe 52*a*, the second connection branch pipe 52*b*, the third connection branch pipe 52*c*, and the fourth connection branch pipe 52*d*, is selectively introduced into the air-cooled heat exchanger 60, the engine exhaust heat exchanger 62, the water-cooled heat exchanger 64, and the ground source heat exchanger 66, by the first opening and closing valve 54*a*, the second opening and closing valve 54*b*, the third opening and closing valve 54*c*, and the fourth opening and closing valve 54*d*.

When the second refrigerant is to be introduced into the air-cooled heat exchanger 60 and the water-cooled heat exchanger 64, the first opening and closing valve 54*a* of the air-cooled heat exchanger 60 and the third opening and closing valve 54*c* of the water-cooled heat exchanger 64 are opened, whereas the second opening and closing valve 54*b* of the engine exhaust heat exchanger 62 and the fourth opening and closing valve 54*d* of the ground source heat exchanger 66 are closed Consequently, the second refrigerant is introduced into the air-cooled heat exchanger 60 through the first opening and closing valve 54*a*. The second refrigerant is heat-exchanged with external air in the air-cooled heat exchanger 60 with the result that the second refrigerant is condensed. Also, the second refrigerant is introduced into the water-cooled heat exchanger 64 through the third opening and closing valve 54*c*. The second refrigerant is heat-exchanged with the cooling water in the water-cooled heat exchanger 64 with the result that the second refrigerant is condensed.

The condensed second refrigerant is changed into a low-temperature, low-pressure refrigerant while passing through the connection expansion valve 50e. The low-temperature, low-pressure second refrigerant cools the hybrid device 40, and is then introduced into the second compressor 35 through the second flow passage controller 15 and the second return pipe 25*a*.

At the same time that the outdoor heat exchange unit 300 is condensing the second refrigerant, the first refrigerant is compressed by the first compressor 30, and is then discharged from the first compressor 30. Subsequently, the discharged first refrigerant is introduced into the first flow passage controller 10 through the first discharge pipe 24*b*. The first flow passage controller 10 is switched such that the first discharge pipe 24*b* is connected with the first circulation refrigerant pipe 21, and the first return pipe 24*a* is connected with the second circulation refrigerant pipe 19. Consequently, the first refrigerant flows along the first circulation refrigerant pipe 21.

The first refrigerant, flowing along the first circulation refrigerant pipe 21, is heat-exchanged with the hybrid device 40 with the result that the first refrigerant is cooled and condensed.

The condensed first refrigerant is distributed into the first sub-indoor unit 27, the second sub-indoor unit 28, and the third sub-indoor unit 29, through the first refrigerant branch pipe 18*a*, the second refrigerant branch pipe 18*b*, and the third refrigerant branch pipe 18*c*. The first refrigerant, distributed through the first refrigerant branch pipe 18*a*, the second refrigerant branch pipe 18*b*, and the third refrigerant branch pipe 18*c*, is changed into a low-temperature, low-pressure refrigerant while passing through the first expansion valve 16*a*, the second expansion valve 16*b*, and the third expansion valve 16*c*. The first refrigerant is heat-exchanged with indoor air in the first sub-indoor unit 27, the second sub-indoor unit 28, and the third sub-indoor unit 29. After that, the first refrigerant is returned into the first compressor 30 through the second circulation refrigerant pipe 19, the first flow passage controller 10, and the first return pipe 24*a*.

The heating operation performed by the engine exhaust heat exchanger 62 and the ground source heat exchanger 66 in the outdoor heat exchange unit will be described with reference to FIG. 1B. First, the second refrigerant is compressed by the second compressor 35, and is then discharged from the second compressor 35. Subsequently, the discharged second refrigerant is introduced into the second flow passage controller 15 through the second discharge pipe 25*b*. The second flow passage controller 15 is switched to a second mode, and therefore, the second refrigerant flows along the first connection refrigerant pipe 41. As shown in FIG. 1B, the second mode is a mode in which the second flow passage controller 15 is switched such that the second discharge pipe 25*b* is connected with the first connection refrigerant pipe 41, and the second return pipe 25*a* is connected with the second connection refrigerant pipe 49.

The second refrigerant, flowing along the first connection refrigerant pipe 41, is introduced into the hybrid device 40. The second refrigerant is condensed while heating the hybrid device 40.

The condensed second refrigerant is introduced into the outdoor heat exchanger 68 through the first refrigerant branch pipe 56*a*, the second refrigerant branch pipe 56*b*, the third refrigerant branch pipe 56*c*, and the third refrigerant branch pipe 56*d*. The condensed second refrigerant is changed into a low-temperature, low-pressure refrigerant while passing through the first expansion valve 50*a*, the second expansion valve 50*b*, the third expansion valve 50*c*, and the fourth expansion valve 50*d*. At this time, the first expansion valve 50*a*, the second expansion valve 50*b*, the third expansion valve 50*c*, and the fourth expansion valve 50*d* control the flow of the refrigerant.

The second expansion valve 50*b* of the engine exhaust heat exchanger 62 and the fourth expansion valve 50*d* of the ground source heat exchanger 66 are opened, whereas first expansion valve 50*a* of the air-cooled heat exchanger 60 and the third expansion valve 50*c* of the water-cooled heat exchanger 64 are closed. Consequently, the second refrigerant is introduced into the engine exhaust heat exchanger 62 through the second expansion valve 50*b*. The second refrigerant is heat-exchanged with heat generated from the engine in the engine exhaust heat exchanger 62, with the result that the second refrigerant is evaporated. Also, the second refrigerant is introduced into the ground source heat exchanger 66 through the fourth expansion valve 50*d*. The second refrigerant is heat-exchanged with ground source heat in the ground source heat exchanger 66, with the result that the second refrigerant is evaporated.

The evaporated second refrigerant is introduced into the second compressor 35 through the second connection refrigerant pipe 49, the second flow passage controller 15, and the second return pipe 25*a*.

At the same time that the outdoor heat exchange unit 300 is evaporating the second refrigerant, the first refrigerant is compressed by the first compressor 30, and is then discharged from the first compressor 30. Subsequently, the discharged first refrigerant is introduced into the first flow passage controller 10 through the first discharge pipe 24*b*. The first flow passage controller 10 is switched such that the first discharge pipe 24*b* is connected with the second circulation refrigerant pipe 19, and the first return pipe 24*a* is connected with the first circulation refrigerant pipe 21. Consequently, the first refrigerant flows along the second circulation refrigerant pipe 19.

The first refrigerant, flowing along the second circulation refrigerant pipe 19, is introduced into the first sub-indoor unit 27, the second sub-indoor unit 28, and the third sub-indoor unit 29, through the first connection branch pipe 22*a*, the second connection branch pipe 22*b*, and the third connection branch pipe 22*c*. The first refrigerant is condensed in the first sub-indoor unit 27, the second sub-indoor unit 28, and the third sub-indoor unit 29.

The first refrigerant, distributed through the first connection branch pipe 22*a*, the second connection branch pipe 22*b*, and the third connection branch pipe 22*c*, is selectively introduced into the first sub-indoor unit 27, the second indoor sub unit 28, and the third indoor sub unit 29, by the first control valve 14*a*, the second control valve 14*b*, and the third control valve 14*c*. The first refrigerant, selectively introduced into the first indoor sub unit 27, the second indoor sub unit 28, and the third indoor sub unit 29, is heat-exchanged with indoor air, and is then flowed to the hybrid device 40 through the circulation expansion valve 16*d*. The first refrigerant, flowed to the hybrid device 40, is introduced into the first compressor 30 through the first flow passage controller 10 and the first return pipe 24*a*.

In this exemplary embodiment, the air conditioner according to the present invention is characterized in that the outdoor heat exchange unit 300 and the intermediate connection unit 200 are installed separately from each other. Consequently, the outdoor heat exchange unit 300, which generates a great deal of vibration, may be installed at the veranda of an apartment such that vibration generated from the outdoor heat exchange unit 300 cannot be transmitted to the interior of the apartment. In this case, it is possible to easily repair or replace the outdoor heat exchange unit 300 or the intermediate connection unit 200 with a new one. In addition, it is possible to manufacture the outdoor heat exchange unit 300 and the intermediate connection unit 200 in a slim structure requiring a small installation space.

While the foregoing descriptions described cooling and heating operations using specific outdoor heat exchangers, it is understood that one or more heat exchangers could be used, either alone or in various combinations, to provide the desired cooling and heating results.

Figure 2:
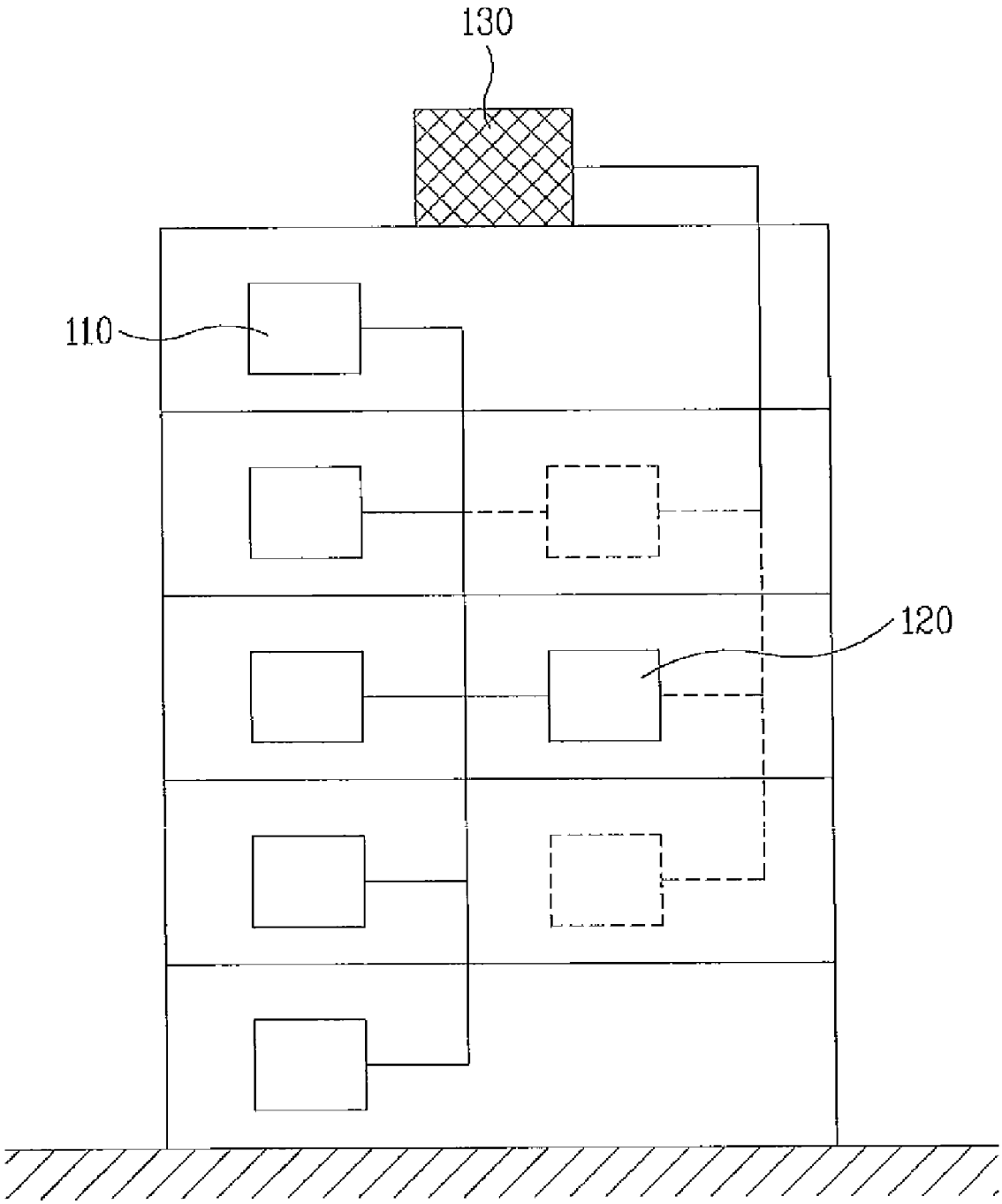
FIG. 2 a view illustrating another exemplary embodiment of an air conditioner according to the present invention, the air-conditioner being installed in a multistoried building.

An air conditioner according to a second exemplary embodiment, as shown in FIG. 2, includes an outdoor heat exchange device 130 and an intermediate connection unit 120 installed in a multistoried building. The intermediate connection unit 120 is disposed between the outdoor heat exchange device 130 and a plurality of indoor sub units 110. Consequently, it is possible to minimize system load due to the difference of altitude when the outdoor heat exchange device 130 is installed in a multistoried building, for example, the veranda of an apartment or at the outside of a building.

Also, in the case that an outdoor heat exchanger of the outdoor heat exchange device 130 is the air-cooled heat exchanger 60 (see FIG. 1), the air-cooled heat exchanger 60 is installed outdoors such that the air-cooled heat exchanger 60 easily keeps in contact with outdoor air. In addition, hot air, generated during the heat exchange with the outdoor air, is prevented from being introduced into the interior of the apartment or building. Consequently, the thermal efficiency is improved, and the noise prevention is accomplished.

As is apparent from the above description, the air conditioner according to the present invention selectively uses various heat exchange modes according to the external environment, and therefore, it is possible to install various kinds of outdoor heat exchange units. Consequently, the present invention has the effect of accomplishing the optimum efficiency depending upon the given external environment.

Also, the outdoor heat exchange unit is installed separately from the intermediate connection unit such that the outdoor heat exchange unit is selectively replaced with a new one. Consequently, the present invention has the effect of easily installing the outdoor heat exchange unit.

Furthermore, because the outdoor heat exchange unit and the intermediate connection unit are installed separately from each other, it is possible to minimize system load when the outdoor heat exchange unit and the intermediate connection unit are installed in a multistoried building. In addition, it is possible to improve the work efficiency when the outdoor heat exchange unit or the intermediate connection unit is replaced with a new one.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

The invention thus being described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed:

1. An air conditioner comprising:

an indoor heat exchange unit to perform a heat exchange process by the supply and absorption of heat through the circulation of a first refrigerant;

at least one outdoor heat exchange unit to perform a heat exchange process by the absorption and supply of heat through the circulation of a second refrigerant;

an intermediate connection unit to perform a heat exchange between the first refrigerant and the second refrigerant;

a first refrigerant pipe connected between the intermediate connection unit and the indoor unit; and a second refrigerant pipe connected between the intermediate connection unit and the at least one outdoor heat exchange unit, wherein the intermediate connection unit includes a case, at least one first compressor within the case to compress the first refrigerant, at least one second compressor within the case to compress the second refrigerant, and a hybrid device to perform heat exchange between the first refrigerant and the second refrigerant, wherein the at least one outdoor heat exchange unit is installed separately from the intermediate connection unit, and the at least one outdoor heat exchange unit is selectively connected to the intermediate connection unit, and wherein the at least one outdoor heat exchange unit includes at least two of an air-cooled heat exchanger, an engine exhaust heat exchanger, a water-cooled heat exchanger, a ground source heat exchanger, and an electric heat exchanger.

2. The air conditioner according to claim 1, wherein the intermediate connection unit includes:

a first flow passage controller to control the flow of the first refrigerant between the intermediate connection unit and the indoor heat exchange unit; and a second flow passage controller to control the flow of the second refrigerant between the intermediate connection unit and the at least one outdoor heat exchange unit.

3. The air conditioner according to claim 1, wherein the hybrid device includes a thermal conductive fluid contained in the case such that the first refrigerant and the second refrigerant are heat-exchanged with each other via the thermal conductive fluid.

4. The air conditioner according to claim 1, further comprising:

a first valve system located in the first refrigerant pipe to control the flow of the refrigerant flowing through the first refrigerant pipe; and a second valve system located in the second refrigerant pipe to control the flow of the refrigerant flowing through the second refrigerant pipe.

5. The air conditioner according to claim 4, further comprising a valve controller for controlling the opening and closing of the first valve system and the second valve system.

6. The air conditioner according to claim 5, wherein the indoor heat exchange unit includes a plurality of sub-indoor units, the first valve system includes a plurality of first valves, each of the plurality of first valves being associated with a corresponding sub-indoor unit, and the valve controller controls the plurality of first valves so as to simultaneously or selectively connect the intermediate connection unit and the sub-indoor units.

7. The air conditioner according to claim 5, wherein the at least one outdoor heat exchange unit includes a plurality of outdoor heat exchange units, the second valve system includes a plurality of second valves, each of the plurality of second valves is associated with a corresponding one of the plurality of outdoor heat exchange units, and the valve controller controls the plurality of second valves so as to simultaneously or selectively connect the intermediate connection unit and the outdoor heat exchange units.

* * * * *